United States Patent [19]

Kasatkin et al.

[11] 4,027,111

[45] May 31, 1977

[54] RIBBON LOUDSPEAKER

[76] Inventors: Alexei Fedoseevich Kasatkin, ulitsa Pravdy, 7/9, kv. 42; Ilya Afanasievich Feldman, ulitsa Dubininskaya, 6, korpus 1, kv. 269, both of Moscow, U.S.S.R.

[22] Filed: Dec. 8, 1975

[21] Appl. No.: 638,371

[30] Foreign Application Priority Data

Dec. 17, 1974 U.S.S.R. ..... 2083976

[52] U.S. Cl. ..... 179/115 V

[51] Int. Cl.[2] ..... H04R 9/02; H04R 9/06

[58] Field of Search .... 179/114 R, 115 R, 115.5 R, 179/115.5 PS, 115.5 VT, 116, 121 R, 138 R, 138 VL, 139, 117, 181 R, 1 DM, 121 D, 119 R

[56] References Cited

FOREIGN PATENTS OR APPLICATIONS 674,470 6/1952 United Kingdom ..... 179/115 A

*Primary Examiner*—George G. Stellar

*Attorney, Agent, or Firm*—Lackenbach, Lilling & Siegel

[57] ABSTRACT

A ribbon loudspeaker comprises, in accordance with the invention, permanent magnets constituting a disconnected magnetic system and sound reproducing ribbons freely vibrating independently of one another positioned in the gap between the poles of the permanent magnets in the plane of the magnetic force lines. The proposed ribbon loudspeaker ensures increase of efficiency, better quality and sound simpler design and lighter weight, and easily variable radiation pattern.

4 Claims, 2 Drawing Figures

RIBBON LOUDSPEAKER

This invention relates to electroacoustic devices and, in particular, to ribbon loudspeakers.

The invention may be employed in household radio equipment, cinema or concert hall radio apparatus and in other cases, when high-quality sound reproduction is required.

There are known ribbon loudspeakers comprising permanent magnets, positioned in a closed circuit or provided with magnetic circuits to form a closed magnetic system, and freely vibrating sound reproducing ribbons positioned in the gaps between the poles of permanent magnets. The ribbons are made of corrugated current-conducting material.

An already known ribbon loudspeaker comprises two permanent magnets provided with pole pieces and connected by a magnetic circuit forming a closed magnetic system. The sound reproducing ribbon is positioned in the gap between pole pieces. The 8 mm wide gap ensures magnetic density of 4,000 g. wt. The air volume within the magnetic circuit is filled with a sound-absorbing material. The sound ribbon is 7.5 mm wide, 52 mm long and 6 mu thick.

Employment of ribbon loudspeakers with a closed magnetic circuit ensures a certain increase of magnetic density in the gaps. But such a design, however, results in lower efficiency at the expense of absorption of 50% sound energy inside the closed circuit limited by permanent magnets and magnetic circuits and results in worse sound due to presence of inner acoustic space and absence of rear high-frequency radiation, as well as in more complicated design, greater weight of the apparatus and narrower range of adjustment of the radiation pattern.

The object of the proposed invention is to provide higher quality and more natural sound reproduction owing to elimination of the inner acoustic space and appearance of rear radiation.

Another object of the invention is to simplify the design and reduce the weight by elimination of magnetic circuits and sound absorbing material.

Yet another object of the invention is to ensure simplicity and wide range of radiation pattern variations.

Still another object of the invention is to provide higher efficiency of the loudspeaker owing to elimination of absorption of rear radiation.

These objects are achieved by providing a ribbon loudspeaker comprising permanent magnets making up a magnetic system and sound-reproducing ribbons. Freely vibrating independently of each other, each of said ribbons being positioned in the working gap between the poles or respective permanent, magnets, said magnetic system made up of permanent, magnets is, in accordance, with the invention, made disconnected, and said permanent magnets being spaced successively one after the other at a certain distance.

It is advisable that the permanent magnets in the proposed ribbon loudspeaker be positioned one after the other along a straight line.

The permanent magnets in the ribbon loudspeaker are preferably positioned along a curved line successively one after another.

The invention will now be described in greater detail with reference to a specific embodiment thereof, taken in conjunction with the accompanying drawings, wherein.

Figure 1:
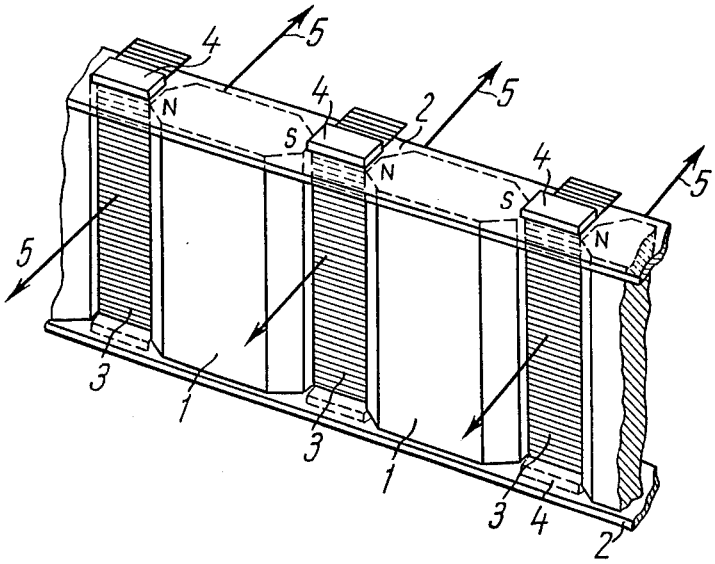
FIG. 1 shows an embodiment of a ribbon loudspeaker, wherein permanents magnets making up a magnetic system are positioned along a straight line, in accordance with the invention.

Referring to FIG. 1, a ribbon loudspeaker comprises permanent magnets 1 positioned successively one after another at some distance along a straight line and making up a disconnected magnetic system. The permanent magnets 1 are secured to the opposite bridges of a frame 2. Freely vibrating ribbons 3 for sound reproduction vibrate independently of each other and are made corrugated and each ribbon is positioned in the working gap between the permanent magnets 1 in the plane of magnetic force lines. The ends of the ribbons 3 for sound reproduction are secured to the frame 2 by means of attachments 4. The ribbons 3 for sound reproduction may be electrically connected in series or in parallel. The extreme points of attachment of the ribbons 3 for sound reproduction to the frame 2 form an electrical input of the ribbon loudspeaker. Arrows 5 indicate the directions of the maximum radiation density.

Figure 2:
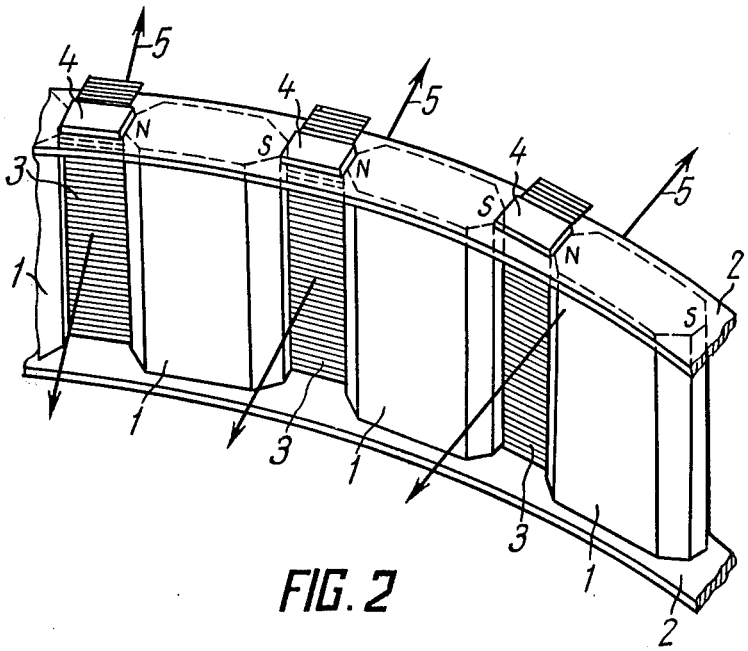
FIG. 2 shows another embodiment of a ribbon loudspeaker, wherein permanent magnets are positioned along a curved line, in accordance with the invention.

Referring to FIG. 2, another embodiment of a ribbon loudspeaker comprises permanent magnets 1 positioned at specified intervals from one another along a curved line. This is advisable to obtain specified radiation patterns.

When a ribbon loudspeaker is switched on, the audio frequency current flowing through the sound reproducing ribbons 3 sets up a magnetic field thereabout, which interacts with the field of permanent magnets 1 and produces mechanical vibrations of the ribbons 3 and, consequently, sound. Employment of permanent magnets without magnetic circuits in ribbon loudspeakers ensures obtaining disconnected magnetic system.

When a ribbon loudspeaker comprises four permanent magnets constituting a disconnected magnetic system and three sound ribbons placed in 7 mm wide working gaps, the efficiency grows by one third and the weight is reduced by 40% as compared to a similarly designed ribbon loudspeaker equipped with a magnetic circuit at the rear of the loudspeaker. The apparatus becomes simple, cheaper, and its sound characteristics are improved. The magnetic density in the working gaps drops by just 15–18%. The drop in magnetic density becomes still less noticeable with a greater number of permanent magnets.

What is claimed is:

1. A ribbon loudspeaker comprising: a plurality of permanent magnets constituting a disconnected magnetic system, said permanent magnets being spaced and positioned successively one after another at a certain distance, a working gap formed between each adjacent pair of said permanent magnets; sound reproducing ribbons freely vibrating independently of each other, each of said sound reproducing ribbons being positioned within a working gap formed between the poles of a respective pair of adjacent permanent magnets.

2. A ribbon loudspeaker as claimed in claim 1, wherein said permanent magnets are positioned successively one after another along a straight line.

3. A ribbon loudspeaker as claimed in claim 1, wherein said permanent magnets are positioned successively one after another along a curved line.

4. A ribbon loudspeaker as defined in claim 1, wherein said ribbons are made of a corrugated current conducting material.

* * * * *